US006739110B2

(12) United States Patent
Ogden et al.

(10) Patent No.: US 6,739,110 B2
(45) Date of Patent: May 25, 2004

(54) METHOD AND APPARATUS FOR PRODUCT PACKAGING

(75) Inventors: John Colin Ogden, Wisbech (GB); Richard Patrick Smith, Wisbech (GB)

(73) Assignee: Buralls of Wisbech Limited, Wisbech (GB)

( * ) Notice: Subject to any disclaimer, the term of this patent is extended or adjusted under 35 U.S.C. 154(b) by 0 days.

(21) Appl. No.: 09/734,816

(22) Filed: Dec. 12, 2000

(65) Prior Publication Data

US 2001/0032441 A1 Oct. 25, 2001

(30) Foreign Application Priority Data

Dec. 17, 1999 (GB) ..... 9929901

(51) Int. Cl.[7] ..... B65B 61/26
(52) U.S. Cl. ..... 53/411; 53/397; 53/399
(58) Field of Search ..... 53/411, 397, 399, 53/461, 55, 58, 131.4, 131.5, 131.2, 48.8

(56) References Cited

U.S. PATENT DOCUMENTS

| | | | | | |
|---|---|---|---|---|---|
| 2,106,276 | A | * | 1/1938 | Heineman | 53/461 |
| 3,295,291 | A | * | 1/1967 | Wood | 53/398 |
| 3,557,521 | A | * | 1/1971 | Pierce, Jr. | 53/48.9 |
| 3,650,773 | A | * | 3/1972 | Bush et al. | 53/411 |
| 3,662,511 | A | | 5/1972 | Eliasberg | |
| 3,666,089 | A | * | 5/1972 | Souza | 206/396 |
| 4,128,954 | A | * | 12/1978 | White | 206/459.5 |
| 4,202,464 | A | * | 5/1980 | Mohs et al. | 206/515 |
| 4,229,925 | A | * | 10/1980 | Stirniman | 53/215 |
| 4,571,923 | A | * | 2/1986 | Le Bras | 53/398 |
| 5,540,381 | A | * | 7/1996 | Davis | 229/103.2 |
| 5,733,652 | A | * | 3/1998 | Stowman et al. | 156/60 |
| 5,810,457 | A | * | 9/1998 | Kano et al. | 400/83 |
| 6,223,499 | B1 | * | 5/2001 | Wilkey | 53/399 |

FOREIGN PATENT DOCUMENTS

| | | |
|---|---|---|
| GB | 2142282 | 1/1985 |
| GB | 2252633 | 8/1992 |

* cited by examiner

*Primary Examiner*—Stephen F. Gerrity
*Assistant Examiner*—Thanh Truong
(74) *Attorney, Agent, or Firm*—Richard M. Goldberg

(57) ABSTRACT

A method of product packaging wherein oblong sleeve-simulating product packaging labels are adapted to be printed with variable product information as weight data and are fed long-edge first towards a product packaging station while being maintain in an indexed relationship to a series of product items which are likewise fed towards the product packaging station. By adopting a long-edge-first feed direction for the packaging elements the indexed relationship with the product items can be established and maintained whereby direct printing of the variable data on the packaging elements or sleeves is feasible without the need to resort to printing on adhesive labels for application to the sleeved product.

6 Claims, 3 Drawing Sheets

METHOD AND APPARATUS FOR PRODUCT PACKAGING

BACKGROUND OF THE INVENTION

This invention relates to a method and apparatus for product packaging. The invention is particularly but not exclusively applicable to packaging for products of the kind which are currently sold with a sleeve-type product identification band or wrapping member which serves to encircle or wrap around a product such as a food product, which may be contained in a dish-format container with (for example) a sealant film.

Sleeve-format product identification and labelling elements are widely accepted in the marketplace as indicative of good product quality. However, although such product identifying and labelling products can be preprinted with high quality technical and other data in any chosen printing format, so that the product itself is attractively displayed, there is a significant shortcoming in the existing systems for providing sleeve-type product labelling and identification, as follows. In short, such systems cannot accommodate the requirement for printing variable information on the packaging. In other words, although such product labelling sleeves can have the product itself attractively and colorfully displayed, they are not capable of being printed with the variable information which product packers need to apply. Examples of such variable information include the product weight and its price, which may vary, and often do, at least slightly, between every single item in a sequence of product units proceeding along a packaging line. Of course, some products do not require to be weighed and variably printed with such data on an in-line basis. Such is the case where the product is of uniform weight and cost, and this particular problem does not arise in such packaging lines.

However, a packaging firm will usually have a series of packaging lines running simultaneously and at least some of these will need the ability to print variable information such as product weight and price on an in-line basis, with the ability to vary the printing between every single item which is passing.

In order to meet this requirement in the case of sleeve-type product packages presently available, the only technically available mode for achieving the result is to print relatively small self adhesive labels which can be applied to the product sleeves, and thus carry the required information.

We have investigated the technical basis for the inability of presently available machinery to variably print sleeve-type product packaging while being able to print small self adhesive labels and the reason is as follows.

We have discovered that there is a technical relationship between firstly the ability of currently available packaging-handling machinery to provide an indexed relationship between items or units of a product moving lengthwise or longitudinally of a feed direction, and secondly the corresponding labelling elements to be applied to such product units on an item-by-item basis. While of course it goes without saying that relatively simple mechanical relationships such as product and labelling element indexing can be achieved by developing an appropriate mechanism, provided sufficient resources are directed at the problem, it nevertheless remains a stumbling block (the reason for which we have discovered) that currently available packaging machinery is subject to the above-identified limitation. And this limitation is due (we have realised) to the fact that such machinery feeds the packaging elements or units, such as the pre-printed oblong-format sheets of card or the like material towards the zone in which they are to be applied (by a machine) to the product units, in an endwise (rather than sidewise) attitude. In other words, the sheet material elements which go to make up the product-encircling sleeves are fed towards the product-application zone with their short (rather than long) ends going first, or leading. To put it another way, we have discovered that it is the attitude in which the product sleeves are fed (an endwise attitude) which leads to the difficulties in indexing them with respect to the units of product themselves, around which the sleeves are to be inserted (in a mechanical glueing and encirclement operation.

We have discovered that if the elements or units of packaging material (which are to be applied to the product in the format of a product encircling sleeve or band, or for example a label adhering to the product and serving to simulate such a band or sleeve) are fed towards the application zone in a laterally-aligned (or long-edge-first) attitude, then they can be properly indexed to the relevant product to which they relate, at the speeds at which machinery of this kind operates.

As a result it is possible to provide in a simple and direct manner, using existing machinery, an in-line printing/labelling facility in which item-by-item data relating to individual units of the product proceeding along the feed line towards the labelling zone are individually printed. The product is weighed (for example) and that weight, and perhaps the corresponding product price, are then allocated to a corresponding individual product labelling or packaging element. This is proceeding independently along its own feed line or web in the direction of the product labelling zone, and the data is printed on that specific product labelling or packaging element, and same is reliably applied to the relevant product unit which at the time of printing of this variable information is completely separate from its labelling or packaging element. The option of overcoming the indexing or relationship-establishing problem as between the labelling or packaging elements and the product units or elements cannot be overcome by the simple expedient of variably printing the relevant data directly on the product after it has been labelled, because in most cases such printing is technically out of the question due to the difficulties inherent in printing on a surface when it has a variable or perhaps negligible degree of support below the printed surface.

SUMMARY OF THE INVENTION

An object of the present invention is to provide a method and corresponding apparatus for product labelling and/or packaging offering improvements in relation to one or more of the shortcomings of the prior art as discussed herein, or improvements generally.

According to the present invention there is provided a method and corresponding apparatus for labelling and/or packaging products, as defined in the accompanying claims.

In embodiments of the invention we provide a method and apparatus in which product labelling elements or units, which are adapted to simulate product labelling sleeves, are provided. These labelling elements carry the usual pre-printed information and product identification on their outer surface. Their lower surface carries adhesive for application to the product, though it may not always be necessary for the entire lower surface to be coated with adhesive, depending upon particular product requirements.

These product labelling elements are used in the principal application of the product in the manner of a product sleeve-simulating label which is applied to, for example, three surfaces of the product namely the upper surface and the two side surfaces. There will usually be no need and it will usually not be convenient to cause the label to adhere to the lower surface of the product since this will not affect the effectiveness of the simulation of the product sleeve (with its attendant customer quality implications), but such may of course be adopted if so desired.

In an alternative and presently less preferred alternative embodiment of the invention the product labelling or packaging elements could be used in the format of product-encircling sleeves or bands which could be caused to encircle the product by a simple wrap-around technique with the application of adhesive to the overlapped ends. Such differs not particularly significantly from a product label secured directly to the product by adhesive, and the factors relating to variable printing and indexing of the product as described above and below are not affected by such a change.

In the embodiments also, the product units themselves are fed on a sequential basis and item-by-item lengthwise of a feed line, for example on a conveyor belt, towards the labelling/packaging/product identification zone. The product elements may be trays of pre-prepared food, but other products may well be packaged and/or labelled with advantage in accordance with the teaching of the present invention.

In accordance with one important feature of the present invention the mode of feeding of the product labelling and/or packaging elements towards the labelling or packaging zone is such that the general disposition of the labelling or packaging elements is that they extend laterally with respect to their feed direction. In other words, the longer dimension of the labelling or packaging elements extends laterally with respect to that direction rather than longitudinally. In this way the labelling or packaging elements are capable of being disposed on their feed web, or as part of a feed web which is proceeding generally in the same direction as the web or conveyor carrying the product elements. And, although these two webs or conveyors are not necessarily lying strictly alongside each other an at least approximate dimension-for-dimension relationship, or item-for-item relationship between each labelling or packaging element and its corresponding product item or unit can be established. In the most straightforward example this reduces to the following. The label to be applied to the tray or container of food, to simulate a sleeve for that container, is of a width such as to cover only a portion of the dimension (usually the length dimension) of the food tray to which it is to be applied, whereas the length of that label may be significantly greater than the length of that tray since the tray itself may be generally square in format or only slightly longer than it is wide, whereby the added length needed by the label for accommodating the depth of the tray adds significantly to its length.

In the case where the product, for example a food tray, is relatively long and thin in format, then it might be possible to achieve a properly-indexed relationship between the corresponding product label or packaging and individual product items (on the basis of existing packaging machinery) with the label attitude the reverse of that adopted in the present invention, but such an exceptional case is not of particular commercial significance for the purposes of the present invention, and accordingly the principal and central aspects of the present invention are not directed to this specific application, but such is hereby identified as part of the invention.

It is to be understood that in the embodiments of the present invention the feeding of the product labelling or packaging elements in the feed direction will typically be with the individual elements of labelling or packaging disposed in a spaced-apart relationship on (for example) a sheet or web of release material serving to provide a defined spaced relationship between the individual elements in accordance with the requirements of the labelling/packaging and printing machinery which they are processed and handled by. It is of course perfectly feasible that the labels or packages may be in a continuous web without the need for a backing web or the like, or in any other convenient relationship, provided the disposition of the packaging elements is in accordance with the principles of the present invention in order to achieve the required indexed relationship with the product items or units.

In accordance with a further important feature of the present invention there is provided in the embodiments of the invention an indexed relationship between the product units themselves and the units or items of labelling or packaging material. The indexed relationship amounts of course to an invisible link between items of product and items of labelling/packaging. More specifically, in a typical example a particular product item will be weighed as the product items pass in sequence over a weighing location in the feed line, and the weight (and therefore the calculated product price) of that specific product item is then available to be printed by the printing machinery on the corresponding labelling/packaging unit having an indexed relationship therewith. This relationship is of course maintained until the two indexed items are united in the labelling/packaging step itself.

In the embodiments of the invention the printing of the relevant variable information, such as the sell-by date and/or weight and/or price etc can be carried out at any convenient stage after the indexed relationship between a given item of product and a given item of its labelling or packaging has been established and many types of known printing apparatus can perfectly well carry out this (in itself) conventional printing step. However, it needs to be understood that there is nothing conventional or known about the feature of the embodiments of the invention whereby this printing of variable information (which may vary for every single one of a stream of products passing at high speed down a packing line) is provided directly on an in-line basis on the main packaging and product-identifying material such as a product-enveloping label or sleeve, as opposed to being printed on a relatively tiny adhesive label which is applied to the product in an individual and additional step needed for that purpose, with attendant cost implications and product perceived quality (loss) implications.

The embodiments of the present invention provide the packing line user with the significant step forward that there is no longer any need for differences of packing or labelling materials between packing lines which pack products of constant weight or lines packing products or varying weight, or other product variations. The embodiments of the present invention can accommodate all such variations (or lack of them) while providing a simple product identification and product data-printing process of wide application in the food and related industries.

It is to be understood that the indexing advantage provided by the wide-edge-leading feature of the embodiments of the invention is due in no small measure to the relatively high speeds at which packing lines operate. These speeds lead to significant problems in terms of product and labelling and packaging convergence and congestion, and well-defined relationships (as in the still-relevant reported Molins case) and the significance of the technical features concerning wide-edge-leading in the embodiments of the present invention are to be interpreted accordingly.

BRIEF DESCRIPTION OF THE DRAWINGS

Embodiments of the invention will now be described by way of example with reference to the accompanying drawings in which.

DETAILED DESCRIPTION

Figure 1:
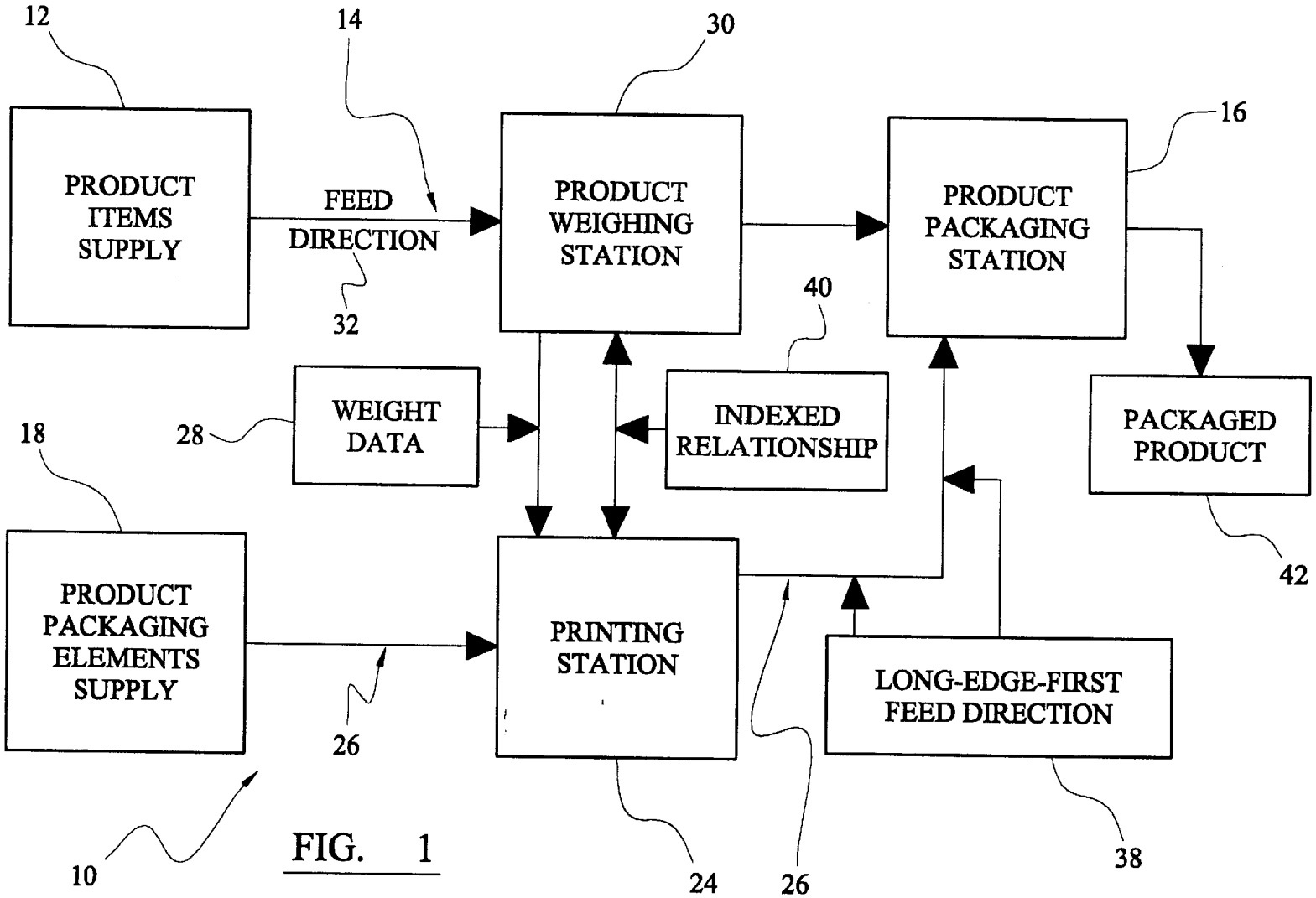
FIG. 1 shows a flow diagram illustrating a method of product packaging in accordance with an embodiment of the invention in which product items are fed in a feed direction to a product weighing station and product packaging station and product packaging elements are fed from a supply to a printing station and thence to the product packaging station.

As shown in FIG. 1, a method of product packaging is adapted for use with currently available product packaging machinery, for example the Genesis model packaging apparatus obtainable from Herbert Industrial of Haverhill Suffolk. This embodiment of the present invention is disclosed on the basis that it is applicable to packaging machinery of this general kind which is currently on the market and which is in accordance with the teaching of the invention adapted to provide an enhancement of its presently available functions.

As shown in FIG. 1 apparatus 10 is adapted to carry out a method of product packaging of the kind wherein a series of product items (not shown individually) but indicated generally in FIG. 1 by product items supply 12, are fed lengthwise of a product feed line indicated generally at 14 to a product packaging station 16. At the product packaging station 16, a series of oblong product packaging elements adapted to be mounted on the product items in sleeve or sleeve-simulating format are each applied to respective ones of the series of products by being caused to be held to the product and to extend around an entire periphery of the product or at least around a major portion of the periphery thereof.

Figure 2:
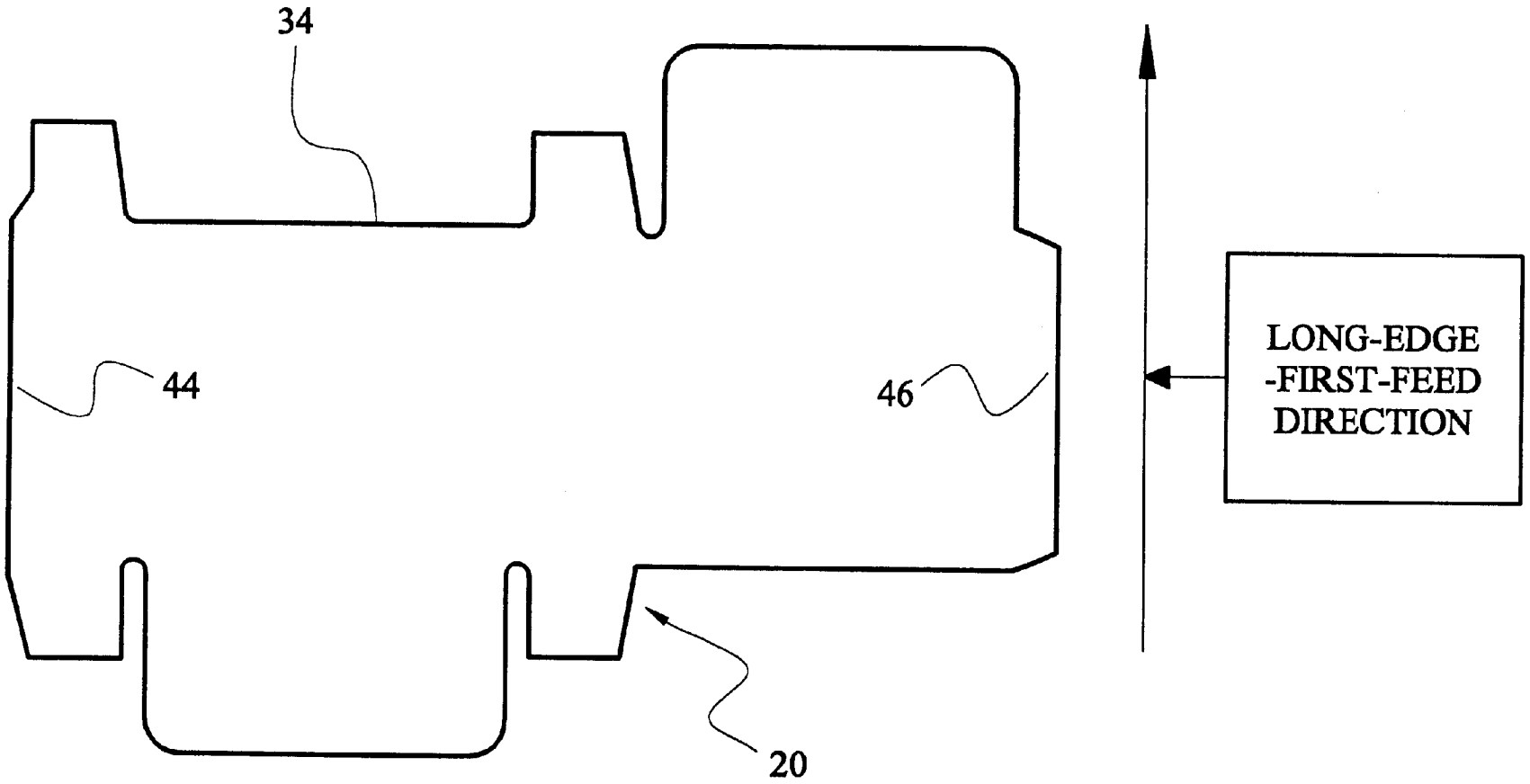
FIG. 2 shows a plan view of one embodiment of a product packaging element for use in an embodiment of the invention and showing the long-edge-first feed direction applicable to same.
Figure 3:
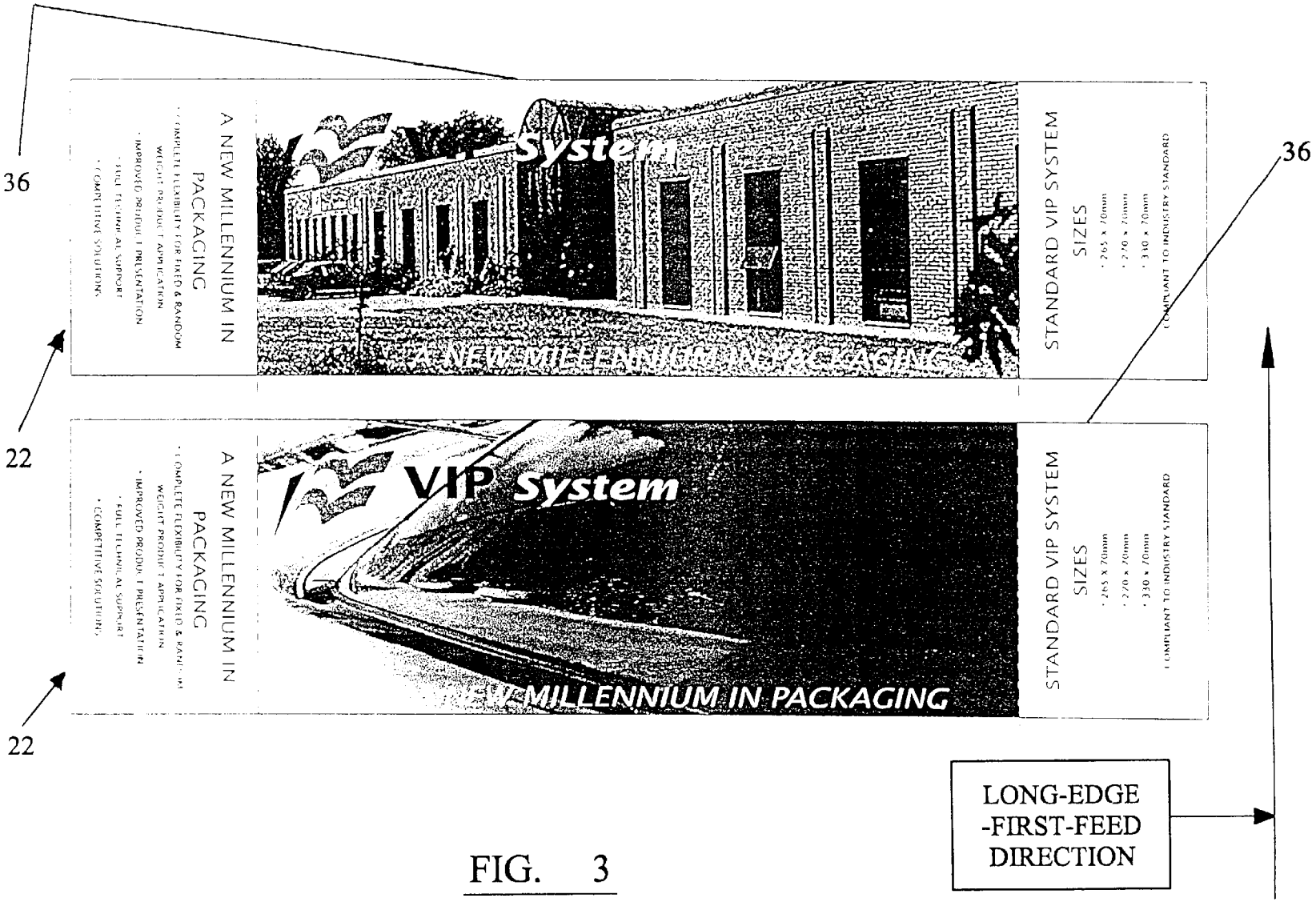
FIG. 3 shows two product packaging elements according to another embodiment of the invention arranged in aligned disposition and likewise showing the long-edge-first feed direction adopted in use during the packaging process.

In FIG. 1, the individual product packaging elements are not shown but these are indicated generally in terms of the product packaging elements supply 18. FIGS. 2 and 3 show samples of individual product packaging elements 20 and 22 forming two embodiments of packaging elements in the present invention.

A typical example of a product item for use in relation to the present invention is a transparent plastic container (for example for containing yellow honeydew melon) having an overall length dimension of 143 mm (maximum dimension of the snap-fit product lid) and an overall width dimension (likewise lid dimension) of 115 mm the container having a generally oval plan view profile and being a ribbed molding in a suitable transparent plastics material. To such a product is to be applied the sleeve-format product packaging element 20 of FIG. 2 or the adhesive-format product packaging elements or labels 22 of FIG. 3.

Variable information relating to individual ones of the series of product items is printed in the apparatus 10 of FIG. 1 on printable surfaces is caused to be carried by the product packaging elements 20 or 22 on the relevant ones of the product items when the product packaging elements have been applied thereto. This is achieved by establishing an indexed relationship between the printed printable surfaces of the product packaging elements and the product items.

In accordance with the general concept of the present invention the step of providing the printable surfaces on the product packaging elements and the step of printing the variable information directly on the printable surfaces of the product packaging elements is carried out as these pass sequentially through a printing station 24. The product packaging elements are fed from their supply 18 to printing station 24 along packaging elements feed line 26 and at the printing station the printing machinery is fed with weight data 28 from a product weighing station 30 provided on the product feed line 14 and adapted to effect on an item-by-item basis weighing of the individual product items as they pass lengthwise of product feed line 14. Accordingly printing station 24 is adapted to be able to print individual product packaging elements with weight data corresponding to respective individual ones of the product items passing lengthwise (in the feed direction 32 along product line 14).

The step of establishing an indexed relationship between the printed printable surfaces on the product packaging elements and the product items is provided by feeding the oblong product packaging elements in a series moving in the feed direction towards the product packaging station 16 with the long edge 34 of product packaging element 20 or the long edge 36 of product packaging element 22 in FIG. 3 extending generally transverse to the direction of feed of the product packaging element. In other words, the feed direction is long-edge first as indicated at 38.

It will be seen from FIG. 2 that long edge 34 is not a linear edge, whereas long edge 36 in FIG. 3 is linear. Adoption of the phrase "long edge" is not intended to imply an entirely straight edge but is intended to refer to the longer dimension of the oblong packaging element, whatever its actual edge profile may be.

In the embodiment of FIGS. 1 to 3, the adoption of the long-edge-first feed direction 38 enables the indexed relationship 40 between the product packaging element 20 or 22 proceeding lengthwise of feed line 26 to product packaging station 16 to be established with the individual product items proceeding lengthwise of product feed line 14 likewise to packaging station 16, whereby when the product items and the packaging elements converge at the packaging station, the interception of each product item with its indexed product packaging element is readily achieved with direct application of the packaging element to its relevant product item. In the case of the sleeve-format product packaging element 20 of FIG. 2, the wrap-around-and-join steps are carried out in accordance with known techniques. The variable information has already been printed on the packaging element and it is then complete and ready to be despatched as variably-printed packaged product 42.

Likewise, in the case of the adhesive-format product packaging elements 22 of FIG. 3 the adhesive underside (non-printed) is applied to the product by techniques known in the field in relation to adhesive label application. Usually, the length of the packaging elements 22 will be just sufficient to encompass the top and the two sides of the product item and usually without the need for any portion of the packaging element to pass under (and be adhered-to) the underside of the product item.

The adhesive product packaging elements 22 are fed in direction 38 with suitable release material protecting the adhesive on their undersides, in accordance with known techniques for adhesive labels, followed by removal of same when required for application to the product. In the case of the sleeves 20 of FIG. 2 the adhesive bond between the overlapping end portions of sleeve 20 is likewise achieved by known techniques which are not affected by the variable printing or other features of the present invention.

We claim:

1. A method of product packaging, comprising the steps of:

a) feeding a series of product items lengthwise of a product line along an automatic machine feed line to a product packaging station;

b) obtaining weight information of each product;

c) providing said weight information to a printing station;

d) printing variable information relating to said weight information in correspondence to each individual one of said series of product items in a specific one to one relation directly on printable surfaces of a series of individual oblong product packaging elements to be applied to said product items as the product packaging elements pass sequentially through said printing station such that different packaging elements corresponding to different product items of said series can have different variable information printed thereon;

e) feeding the product packaging elements in a feed direction along an automatic packaging machine feed line with a long edge of each product packaging element extending generally transverse to said feed direction;

f) feeding the product packaging elements with said long edge in an indexed relationship with said product items; and g) at applying each of said individual oblong product packaging elements in a sleeve or sleeve-simulating format to respective ones of said series of product items in said product packaging station in said specific one to one relation by causing each product packaging element to be held to the respective product item and to extend at least around a major portion of a periphery of the product item.

2. A method according to claim 1, wherein said variable information comprises at least one of:

a) said weight information; and b) price information relating to said weight information.

3. A method according to claim 1, wherein said product packaging elements include elements having opposite ends, and said step of applying each of said oblong product packaging elements in a sleeve or sleeve-simulating format to respective ones of said series of product items in said product packaging station includes the step of joining together the opposite ends of each product packaging element to produce a complete sleeve.

4. A method according to claim 1, wherein said product packaging elements include elements adapted to be adhered to said product items, and said step of applying each of said oblong product packaging elements in a sleeve or sleeve-simulating format to respective ones of said series of product items in said product packaging station includes the step of extending said product packaging elements around only a major portion of each product item so that said product packaging element simulate a sleeve.

5. A method according to claim 1, wherein said step of applying each of said oblong product packaging elements in a sleeve or sleeve-simulating format to respective ones of said series of product items in said product packaging station includes the step of causing each product packaging element to be held to the respective product item and to extend around a major portion of a periphery of the product item.

6. A method of product packaging, comprising the steps of:

providing a printable surface on each of a series of individual oblong product packaging elements, obtaining weight information of each of a series of product items as the series of product items are moved along an automatic machine feed line, providing said weight information to a printing printing different variable information relating to said weight information in correspondence to each individual one of said series of product items in a specific one to one relation directly onto said printable surfaces of said product packaging elements as the product packaging elements pass sequentially through said printing station such that different packaging elements corresponding to different product items of said series can have different variable information printed thereon, establishing an indexed relationship between said printed printable surfaces of said individual product packaging elements and said series of product items by feeding said individual oblong product packaging elements in series moving in a feed direction towards a product packaging station along an automatic packaging machine feed line, and orienting said individual product packaging elements with a long edge of each product packaging element extending generally transverse to the feed direction of said product packaging elements.

* * * * *